United States Patent [19]

Wise et al.

[11] 4,193,507

[45] Mar. 18, 1980

[54] COVER FOR BREATHING APPARATUS CANISTER

[75] Inventors: Layton A. Wise, Washington; Robert F. Menold, Monroeville, both of Pa.

[73] Assignee: Mine Safety Appliances Company, Pittsburgh, Pa.

[21] Appl. No.: 10,600

[22] Filed: Feb. 9, 1979

[51] Int. Cl.[2] ..... B65D 41/18

[52] U.S. Cl. ..... 215/12 R; 215/307; 215/321; 150/52 R; 220/258

[58] Field of Search ..... 150/52 R; 215/12 R, 215/277, 307, 321; 220/256, 366, 258

[56] References Cited

U.S. PATENT DOCUMENTS

| | | | |
|---|---|---|---|
| 1,790,299 | 1/1931 | Foreman | 215/12 R |
| 2,287,746 | 6/1942 | Morton | 215/307 |
| 2,452,195 | 10/1948 | Johnson | 215/12 R |
| 2,947,432 | 8/1960 | Marcel | 215/321 |

*Primary Examiner*—Donald F. Norton
*Attorney, Agent, or Firm*—Brown, Flick & Peckham

[57] ABSTRACT

The cover for a breathing apparatus canister has a body portion of substantially the same shape as the top of the canister and is provided with a skirt extending around the upper part of the canister and also with a central opening through which the neck of the canister extends. Extending from the body portion upwardly around the neck is a circular side wall closed at its upper end by a top wall above the sealing ring that encircles the upper end of the neck. The side wall is provided with inwardly projecting detents underlying the sealing ring to hold the cover in place, but the detents are sufficiently yieldable to permit the cover to be applied to the canister and removed.

5 Claims, 2 Drawing Figures

Fig. 1
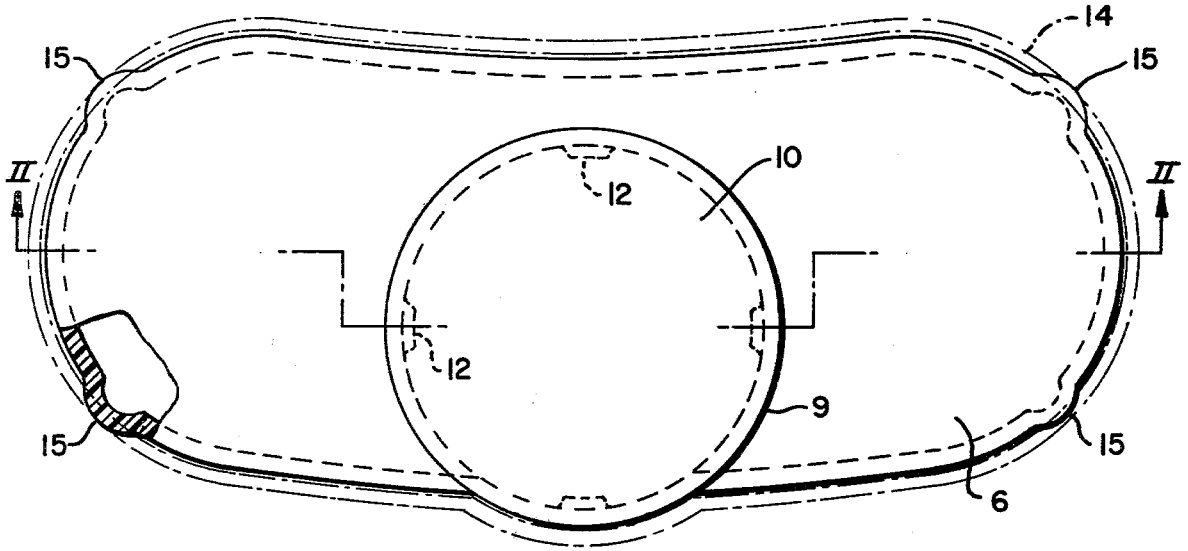
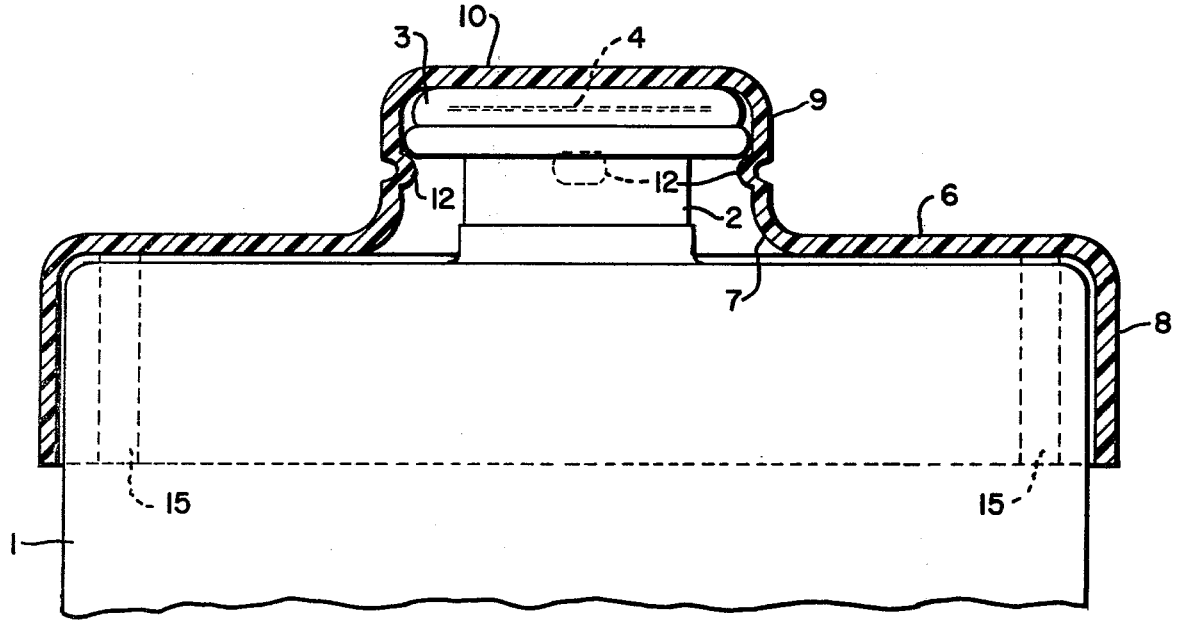
Fig. 2

COVER FOR BREATHING APPARATUS CANISTER

A conventional breathing apparatus canister filled with a chemical, such as shown in U.S. Pat. No. 2,758,015, has an upwardly extending neck encircled at its upper end by a sealing ring. The upper end of the neck is closed and sealed by a disc of copper foil to prevent air from reaching the chemical. This seal is broken when the canister is moved into operating position in breathing apparatus such as shown in U.S. Pat. Nos. 2,403,981 and 2,693,181. On the other hand, while the canister is in storage or being shipped or otherwise handled; it is desirable to protect the neck from being bent and to prevent the copper seal from being broken accidentally.

Accordingly, it is an object of this invention to provide a protective cover for such a canister which is snapped in place, which can be removed readily, which is transparent so that the condition of the seal can be observed and which is provided with means to prevent insertion of the canister in the canister-receiving receptacle of breathing apparatus while the cover is in place.

The preferred embodiment of the invention is illustrated in the accompanying drawings in which FIG. 1 is a plan view of the cover; partly in section and FIG. 2 is a vertical section of the cover taken on the line II—II of FIG. 1 and showing the cover applied to a chemical canister, only the upper portion of which is shown.

Referring to the drawings, a breathing apparatus canister 1 is filled with a chemical, such as $KO_2$, that absorbs carbon dioxide and liberates oxygen when exposed to moisture in the exhaled breath of a user. Extending upwardly from the usual opening in the top of the canister is a neck 2, the upper end of which is encircled by a sealing ring 3. The upper end of the neck also is closed by a copper foil seal 4.

To protect the neck and seal in accordance with this invention, the upper part of the canister is enclosed by a cover. This cover has a flat body portion 6 of substantially the same shape as the top of the canister, but slightly larger, and it is provided with a central opening 7, through which the canister neck extends. Extending downwardly from the periphery of this body portion of the cover is a skirt 8 that surrounds the upper part of the canister in close proximity to it but yet spaced a short distance from the canister to provide clearance between them. Extending from the body portion of the cover upwardly around the canister neck is a circular side wall 9 closed at its top by a top wall 10. The dimensions of the cover are such that when this top wall rests on sealing ring 3 the body portion of the cover is spaced a short distance from the top of the canister to provide clearance communicating with the clearance between the canister and cover skirt.

To hold the cover in place on the canister, the circular side wall 9 of the cover encircling the canister neck is provided at circumferentially spaced intervals with inwardly projecting detents 12 that underlie the sealing ring. The cover is applied to the canister by pressing the cover downwardly to cause the detents to slide down across the sealing ring and snap in below it. They are sufficiently yieldable for this purpose and also for permitting the cover to be pulled off the canister when desired. If desired, the detents can be located at a higher level and press into sealing ring 3 to hold the cover in place.

In case the seal 3 at the upper end of the canister neck starts to leak, moisture in the air may enter the canister and cause the chemical to start generating oxygen. This gas escaping from the canister can flow to the atmosphere through the clearance spaces between the cover and canister without blowing the cover off the canister. Since the canister is most likely provided with an oxygen candle that is ignited to start generation of oxygen, if the candle is accidentally ignited while the canister is still sealed the sudden increase of pressure inside the canister will rupture seal 4 and raise the cover far enough to permit the gas to escape from the canister.

To prevent the canister from being inserted in the receiving housing 14, indicated by dotted lines, of breathing apparatus while the cover is in place, the cover is provided with some lateral projections that enlarge it enough to keep it from entering the housing. Preferably, these projections are vertical ribs 15 along the outside of the cover skirt.

Although the cover can be made of metal if desired, it is preferred to mold it from plastic that is transparent so that the condition of the canister seal can be observed. With a molded plastic cover, the detents and the ribs can readily be formed during the molding operation.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. The combination with a breathing apparatus canister having a top wall with an upwardly extending neck encircled at its upper end by a sealing ring and with the neck closed by a seal, of a protective cover for the canister comprising a body portion of substantially the same shape as the top wall of the canister and provided with a central opening through which said neck extends, a skirt extending downwardly from said body portion around the upper part of the canister in close proximity thereto, a circular side wall extending from said body portion upwardly around said neck, and a top wall joined to said side wall and covering said ring and seal, said side wall being provided at circumferentially spaced intervals with inwardly projecting detents underlying portions of the sealing ring to hold the cover in place, said detents being sufficiently yieldable to permit the cover to be applied and pulled off the canister manually.

2. The combination recited in claim 1, in which there is clearance between the canister and said skirt and body portion of the cover for escape of gas accidentally released from the canister.

3. The combination recited in claim 1, in which said cover is provided with a plurality of lateral projections to prevent its insertion in the canister receptacle of breathing apparatus.

4. The combination recited in claim 3, in which said projections are ribs projecting from said skirt and extending downwardly along the skirt.

5. The combination recited in claim 4, in which said ribs are outwardly offset portions of said skirt.

* * * * *